US009556736B2

(12) United States Patent
Sigurdsson

(10) Patent No.: US 9,556,736 B2
(45) Date of Patent: Jan. 31, 2017

(54) HYDRAULIC MACHINE, IN PARTICULAR HYDRAULIC PRESSURE EXCHANGER

(71) Applicant: Danfoss A/S, Nordborg (DK)

(72) Inventor: Haraldur Sigurdsson, Arhus V (DK)

(73) Assignee: Danfoss A/S, Nordborg (DK)

( * ) Notice: Subject to any disclaimer, the term of this patent is extended or adjusted under 35 U.S.C. 154(b) by 373 days.

(21) Appl. No.: 14/450,574

(22) Filed: Aug. 4, 2014

(65) Prior Publication Data

US 2015/0050164 A1 Feb. 19, 2015

(30) Foreign Application Priority Data

Aug. 15, 2013 (EP) ..... 13180508

(51) Int. Cl.
*F04F 13/00* (2009.01)
*F01B 3/00* (2006.01)
(Continued)

(52) U.S. Cl.
CPC ..... *F01B 3/0032* (2013.01); *F04B 1/20* (2013.01); *F04B 1/24* (2013.01); *F04B 9/109* (2013.01);
(Continued)

(58) Field of Classification Search
CPC ..... F04F 13/00; F02B 33/42; B01D 61/06; F15B 3/00; F04B 9/1176; F04B 9/109; F04B 9/117; F04B 1/20; F04B 1/24; F04B 17/00; F04B 17/03; F01B 3/0032
(Continued)

(56) References Cited

U.S. PATENT DOCUMENTS 2,675,173 A * 4/1954 Jendrasski ..... F04F 13/00 417/225
2,766,928 A * 10/1956 Boszormenyi ..... F04F 13/00 415/134
(Continued)

FOREIGN PATENT DOCUMENTS

CN 1272166 A 11/2000
CN 1489672 A 4/2004
(Continued)

OTHER PUBLICATIONS

European Search Report for European Patent Application No. EP13180505 dated Nov. 20, 2013.
(Continued)

*Primary Examiner* — Devon Kramer
*Assistant Examiner* — Nathan Zollinger
(74) *Attorney, Agent, or Firm* — McCormick, Paulding & Huber LLP

(57) ABSTRACT

A hydraulic pressure exchanger comprising a drum rotatable about an axis, a front plate arrangement having a front plate and a pressure shoe, said drum including a plurality of working cylinders, each working cylinder having a front opening and, during rotation of this drum, said front opening sliding over said pressure shoe along a path, said pressure shoe having at least two kidney-shaped openings, said kidney-shaped openings being arranged in said path. The hydraulic pressure exchanger should be operated with low noise. To this end said pressure shoe is arranged between said drum and said front plate and comprises at least one pressure cylinder arranged between two neighboring kidney-shaped openings, a piston being arranged in said pressure cylinder and resting against said front plate, said pressure cylinder being connected with a supply opening in
(Continued)

a side of the pressure shoe opposite said front plate, said opening at least partly overlapping said path.

20 Claims, 2 Drawing Sheets

(51) Int. Cl.

| | |
|---|---|
| ***F04B 1/20*** | (2006.01) |
| ***F04B 1/24*** | (2006.01) |
| ***F04B 9/117*** | (2006.01) |
| ***F04B 17/00*** | (2006.01) |
| ***F04B 17/03*** | (2006.01) |
| ***F04B 9/109*** | (2006.01) |

(52) U.S. Cl.
CPC ..... *F04B 9/117* (2013.01); *F04B 17/00* (2013.01); *F04B 17/03* (2013.01); *F04F 13/00* (2013.01)

(58) Field of Classification Search
USPC ..... 417/64; 60/39.45
See application file for complete search history.

(56) References Cited

U.S. PATENT DOCUMENTS

| | | | | |
|---|---|---|---|---|
| 3,190,542 | A * | 6/1965 | Vickery | F02B 33/42 417/64 |
| 3,398,699 | A | 8/1968 | Stark | |
| 3,405,641 | A | 10/1968 | Coberly | |
| 3,431,747 | A * | 3/1969 | Hashemi | B01D 61/06 417/339 |
| 3,641,881 | A | 2/1972 | Hashemi | |
| 4,174,925 | A * | 11/1979 | Pfenning | B01D 61/06 251/208 |
| 4,269,570 | A * | 5/1981 | Rao | F01D 5/025 415/217.1 |
| 4,887,942 | A * | 12/1989 | Hauge | F15B 3/00 417/64 |
| 6,537,035 | B2 * | 3/2003 | Shumway | F04F 13/00 417/64 |
| 6,773,226 | B2 * | 8/2004 | Al-Hawaj | B01D 61/06 415/116 |
| 7,080,633 | B2 * | 7/2006 | Wenger | F04F 13/00 123/559.2 |
| 7,201,557 | B2 * | 4/2007 | Stover | F04F 13/00 415/104 |
| 7,207,781 | B2 * | 4/2007 | Shumway | B01D 61/06 210/321.65 |
| 7,214,315 | B2 * | 5/2007 | Shumway | B01D 61/06 210/137 |
| 7,306,437 | B2 * | 12/2007 | Hauge | F04F 13/00 210/652 |
| 7,799,221 | B1 | 9/2010 | MacHarg | |
| 7,815,421 | B2 * | 10/2010 | Bross | F04F 13/00 417/375 |
| RE42,432 | E * | 6/2011 | Stover | F04F 13/00 415/104 |
| 7,997,853 | B2 * | 8/2011 | Pique | B01D 61/06 415/116 |
| 8,075,281 | B2 * | 12/2011 | Martin | F04F 13/00 417/64 |
| 8,622,714 | B2 * | 1/2014 | Andrews | F04B 7/0023 417/64 |
| 2004/0052639 | A1 | 3/2004 | Al Hawaj | |
| 2005/0249619 | A1 | 11/2005 | El-Sayed et al. | |
| 2011/0006006 | A1 | 1/2011 | MacHarg | |
| 2011/0176936 | A1 * | 7/2011 | Andrews | F04B 7/0023 417/64 |
| 2014/0048143 | A1 * | 2/2014 | Lehner | F04F 13/00 137/14 |
| 2015/0050167 | A1 * | 2/2015 | Hirosawa | B01D 61/06 417/406 |
| 2016/0040511 | A1 * | 2/2016 | Theodossiou | E21B 41/00 166/244.1 |

FOREIGN PATENT DOCUMENTS

| | | | |
|---|---|---|---|
| CN | 1994905 | A | 7/2007 |
| CN | 101044325 | A | 9/2007 |
| CN | 101440828 | A | 5/2009 |
| CN | 101925749 | A | 12/2010 |
| DE | 1528525 | | 1/1966 |
| DE | 3614257 | A1 | 10/1987 |
| DE | 10 2008 046 168 | A1 | 3/2010 |
| DE | 10 2010 026 645 | A1 | 1/2012 |
| EP | 1 108 461 | A2 | 6/2001 |
| EP | 1 508 361 | A1 | 2/2005 |
| EP | 2 078 867 | A1 | 7/2009 |
| GB | 1144262 | A | 3/1969 |
| WO | 00/71852 | A1 | 11/2000 |
| WO | 2009074195 | A1 | 6/2009 |
| WO | 2013061229 | A3 | 5/2013 |

OTHER PUBLICATIONS

European Search Report for European Patent Application No. EP13180511 dated Feb. 5, 2014.
European Search Report for European Patent Application No. EP13180508 dated Nov. 12, 2013.

* cited by examiner

HYDRAULIC MACHINE, IN PARTICULAR HYDRAULIC PRESSURE EXCHANGER

CROSS REFERENCE TO RELATED APPLICATION

Applicant hereby claims foreign priority benefits under U.S.C. §119 from European Patent Application No. EP13180508.7 filed on Aug. 15, 2013, the contents of which are incorporated by reference herein.

TECHNICAL FIELD

The invention relates to a hydraulic machine, in particular a hydraulic pressure exchanger, comprising a drum rotatable about an axis, a front plate arrangement having a front plate and a pressure shoe, said drum comprising a plurality of working cylinders, each working cylinder having a front opening, during rotation of said drum, said front openings gliding over said pressure shoe along a path, said pressure shoe having at least two kidney-shaped openings, said kidney-shaped openings being arranged in said path.

BACKGROUND

Such a hydraulic machine is known from EP 1 508 361 A1. This hydraulic machine is a pressure exchanger.

The invention is described in the following in connection with a hydraulic pressure exchanger as an example for a hydraulic machine. The invention can, however, be used in other kinds of hydraulic machines having working cylinders and kidney-shaped openings in a pressure shoe.

The operation of a pressure exchanger can briefly be summarized as follows: a working cylinder passing a first kidney-shaped opening in the pressure shoe connected to a high pressure supply port is filled with liquid under high pressure. Usually a working piston is arranged in the working cylinder. This working piston is moved by the incoming liquid in a direction away from the pressure shoe. The working cylinder on the other side of the working piston has previously been filled with fresh liquid. This fresh liquid is outputted under the action of the working piston. When the drum continues rotating, the working cylinder passes another kidney-shaped opening on the other side connected to a low pressure supply port so that the working cylinder is filled with fresh liquid pushing the working piston in opposite direction and outputs the liquid to be wasted.

A problem arises when the front opening of a working cylinder under high pressure leaves a kidney-shaped opening and passes a closed area on the pressure shoe. In this situation the pressure in the working cylinder creates forces acting against the pressure shoe. These forces tend to separate the pressure shoe and the front opening of the working cylinder. Such separation should be avoided since such separation leads to an unwanted internal leakage.

One approach for avoiding this internal leakage is to press the pressure shoe and the drum together with high forces. However, these high forces increase friction between the drum and the pressure shoe causing wear and noises which should be avoided as well.

SUMMARY

The task underlying the invention is to reduce wear.

This task is solved in a hydraulic machine of the kind mentioned above in that said pressure shoe is arranged between said drum and said front plate and comprises at least a pressure cylinder arranged between two neighboring kidney-shaped openings, a piston being arranged in that pressure cylinder, said piston resting against said front plate, said pressure cylinder being connected with a supply opening in a side of the pressure shoe opposite the front plate, said opening at least partly overlapping said path.

In this case the pressure in the working cylinder enters the pressure cylinder. The pressure in the pressure cylinder presses the piston against the front plate. The forces generated by this pressure generate a counter force pressing the pressure shoe in a direction towards the drum. This pressure, however, is present only as long as the front opening of the working cylinder passes over the closed area between two neighboring kidney-shaped openings. Therefore, these forces can be dimensioned such that an internal leakage is avoided, however, wear and noises are kept small. The term "cylinder" is used to simplify the description. It is not necessary that the cross section of the cylinder is circular. Furthermore, a piston can be arranged in the working cylinder, although this is not necessary in many cases. The working cylinders need not to have a straight form, they can be curved as well.

At least two cylinders are arranged between two neighboring kidney-shaped openings one behind the other in a direction of movement of said working cylinders. This has the advantage that the forces pressing the pressure shoe against the cylinder drum can be adjusted with high precision. The distance between two neighboring kidney-shaped openings must be larger than the diameter of a front opening of a working cylinder in order to avoid a short circuit between the two kidney-shaped openings. The use of at least two pressure cylinders in this closed area allows to generate the tightening forces over a great part of the movement of the front opening of the working cylinder over this closed area.

Preferably said supply opening is arranged eccentrically relative to a center of the pressure cylinder. In this way it is possible to arrange the pressure cylinder and the piston in a suitable position so that they are able to create the forces at an optimum position on the pressure shoe. However, the timing for generating the force can be chosen independently from the positioning.

Preferably the center of said pressure cylinder is arranged closer to the axis than said supply opening. In other words the pressure cylinder is positioned at a radially inner position. However, the supply opening is positioned more outwardly allowing an earlier supply of liquid from the working cylinder to the pressure cylinder.

Preferably said pressure cylinder overlaps at least partly said path. The counter forces are generated in the region of the separating forces.

In a preferred embodiment said pressure shoe comprises a first port and at least a pressing cylinder, said pressing cylinder opening to said front plate, a pressing piston being arranged in said pressing cylinder, said pressing cylinder being in fluid contact with said first port. The pressure shoe is kept unrotatable relative to the front plate. The pressure shoe is pressed against the front face of the drum. The force pressing the pressure shoe against the front face of the drum is at least partly generated by the pressing piston in the pressing cylinder. This pressing piston is loaded by the pressure in the first port which is preferably the highest pressure in the machine. This pressure presses the pressing piston in the pressing cylinder in a direction towards the front plate. This force again creates a counter force pressing the pressure shoe against the drum. The pressure pressing the pressure shoe against the drum should be high enough to achieve the desired tightness. However, it should be not too high in order to avoid excessive wear. The resulting force can be determined rather exactly by the dimensioning of the pressing piston in the pressing cylinder.

Preferably at least two pressing cylinders are arranged in said pressure shoe. In this case the force pressing the pressure shoe against the front face of the drum can be doubled so that each pressing cylinder can be kept small. Furthermore, such a construction has the advantage that the forces act at different positions on the pressure shoe.

In a preferred embodiment said pressing cylinders have the same cross section area. In this way, the forces generated by the pressing pistons in each pressing cylinder are equal since the pressing cylinders are loaded with the same pressure. This makes it easier to distribute the forces in the desired manner.

In a preferred embodiment said pressure shoe comprises two ports on a side facing said front plate, said ports having a minimum distance along a straight line, said pressing cylinder being offset to said straight line by a predetermined displacement. In many cases, the pressure shoe comprises a first shoe port connected to the first port and a second shoe port connected to a second port. When these two ports are arranged on a vertical line, the pressing cylinder is offset to this vertical line in horizontal direction. The same relation is true when the two ports are arranged in another spatial direction. When the pressing cylinder is offset to this straight line between the two ports, there is sufficient space available so that the pressing cylinder can have a sufficiently large diameter.

In a preferred embodiment said pressing cylinder is arranged between said ports. Seen parallel to the above mentioned straight line, said pressing cylinder and said ports overlap each other. This makes it possible to position the pressing cylinder in an area near the center of the pressure shoe.

BRIEF DESCRIPTION OF THE DRAWINGS

A preferred example of the invention will now be described in more detail with reference to the drawing, wherein.

DETAILED DESCRIPTION

Figure 1:
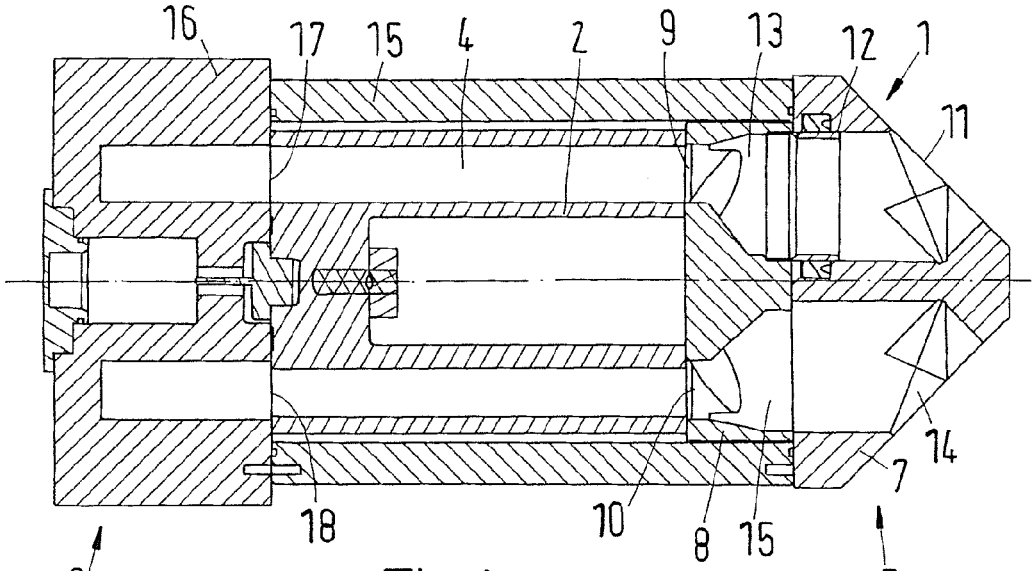
FIG. 1 is a schematic longitudinal section of a hydraulic pressure exchanger.

FIG. 1 schematically shows a hydraulic pressure exchanger 1 in a longitudinal section. The pressure exchanger 1 is an example for a hydraulic machine.

The pressure exchanger 1 comprises a drum 2 rotatable about an axis 3. The term "drum" is used to facilitate the explanation. It is not necessary that this drum 2 is of cylindrical form. The main purpose of the drum 2 is to form a basis for working cylinders 4. The drum 2 comprises a plurality of working cylinders 4, two working cylinders 4 being shown in FIG. 1. The drum 2 can also be termed as "cylinder carrier".

A first front plate arrangement 5 is arranged at a first axial end or front face of the drum 2. A second front plate arrangement 6 is arranged at a second axial end or front face of the drum 2 which is opposite of the first axial end of the drum 2.

The first front plate arrangement 5 comprises a first front plate 7 and a pressure shoe 8. The pressure shoe 8 rests against the drum 2. The pressure shoe 8 is loaded in a direction towards the drum 2 by means explained below. The pressure shoe 8 can also be named "port plate".

The pressure shoe 8 comprises two kidney-shaped openings 9, 10. The opening 9 is in fluid connection with a first port 11. This connection comprises a sleeve 12 and a first channel 13. The other opening 10 is connected to a second port 14 via a second channel 14*a*. Depending on the pressure conditions the first port 11 may be termed "high pressure supply port" and the second port may be termed "low pressure return port". However, in other pressure situations these terms might be misleading. Therefore, only the term "port" is used.

The first front plate 7 is connected to a housing 15. The housing 15 is connected to a second front plate 16 which is arranged on the opposite side of the housing 15 relative to the first front plate 7. The second front plate 16 is part of the second front plate arrangement 6 and comprises two kidney-shaped openings 17, 18 which may be arranged at the same positions in circumferential direction as the kidney-shaped openings 9, 10 in the pressure shoe 8.

Means for rotatably supporting and driving the drum 2 are not shown in order to keep the illustration simple. However, the drum 2 can be rotatable supported within the housing 15. A driving shaft can be passed through the second front plate 16.

The pressure shoe 8 is supported unrotatably in the housing 15, so that it remains stationary in rotating direction relative to the first front plate 7. However, a small movement in a direction towards the drum 2 is possible.

Figure 2:
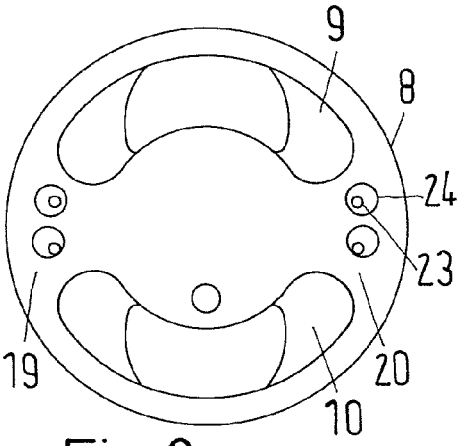
FIG. 2 is a view of a pressure shoe seen from the drum.
Figure 3:
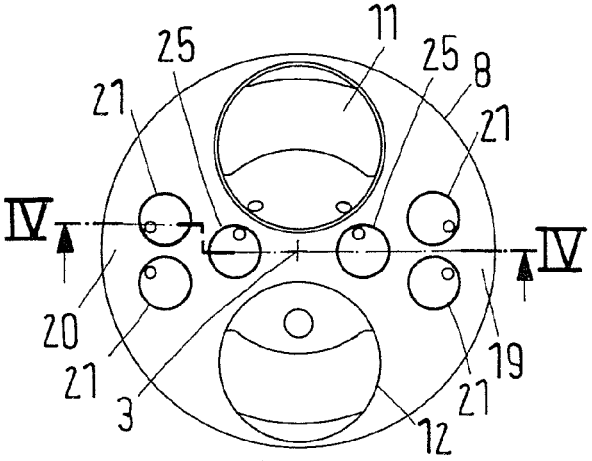
FIG. 3 is a view of the pressure shoe seen from a front plate.
Figure 4:
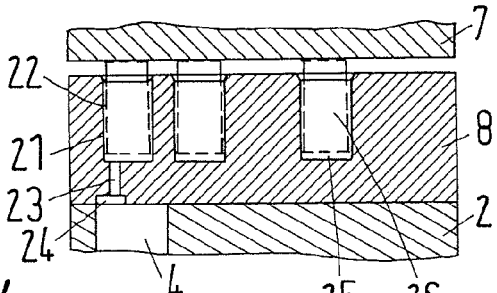
FIG. 4 is a section IV-IV of FIG. 3.

FIGS. 2 to 4 show the pressure shoe 8 with more details.

As it is known in the art, the kidney-shaped openings 9, 10 are arranged within a path along which the front openings of the working cylinders 4 are moved when the drum 2 rotates. However, this path comprises two closed areas 19, 20 separating the two openings 9, 10. The length of the areas 19, 20 in circumferential direction must be longer than a diameter of the working cylinders 4 in order to avoid a short circuit between the openings 9, 10.

In some cases, this causes a problem: when a working cylinder 4 is filled with liquid under high pressure and this working cylinder passes a closed area 19, 20, forces are generated tending to separate the pressure shoe 8 and the drum 2 which could lead to an unwanted internal leakage.

To overcome this problem, the pressure shoe 8 is provided with two pressure cylinders 21 in each closed area 19, 20. A piston 22 is arranged in each pressure cylinder 21. As can be seen in FIG. 4, this piston 22 rests against the first front plate 7. The cylinder 21 is connected via a channel 23 to an opening 24 in a side of the pressure shoe 8 facing the drum 2. The opening 24 overlaps the path so that a pressure in a working cylinder 4 appears in the pressure cylinder 21 as well pressing the piston 22 against the first front plate 7. This pressing force generates a counter force pressing the pressure shoe 8 against the front face of the drum 2.

As can be seen in FIG. 4, the pressure cylinders 21 are arranged to overlap at least partially the moving path of the working cylinders 4. Therefore, the separating forces and the corresponding counter forces are located at the same radius.

The opening 24 is arranged eccentrically to the cylinder 21 for timing purposes. In the present embodiment, each closed area 19, 20 comprises two pressure cylinders 21 so that sufficient counter forces can be generated. Furthermore, two pressure cylinders 21 allow to react on the pressure in two neighboring working cylinders 4 at the same time.

The pressure shoe 8 furthermore comprises two pressing cylinders 25, each pressing cylinder 25 being provided with a pressing piston 26. The pressing cylinders 25 are connected to the first port 11 so that the pressure in the first port 11 acts on the pressing pistons 26 in the pressing cylinders 25. This has the effect that the pressure shoe 8 is pressed against the drum 2. The pressing cylinders 25 are arranged between the two ports 11, 14 in the first front plate 7. However, they are offset in radial direction with respect to the axis 3.

The pressing cylinders 25 and correspondingly the pressing pistons 26 have the same cross section area, so that the forces generated by the pressing pistons 26 are equal.

Figure 5:
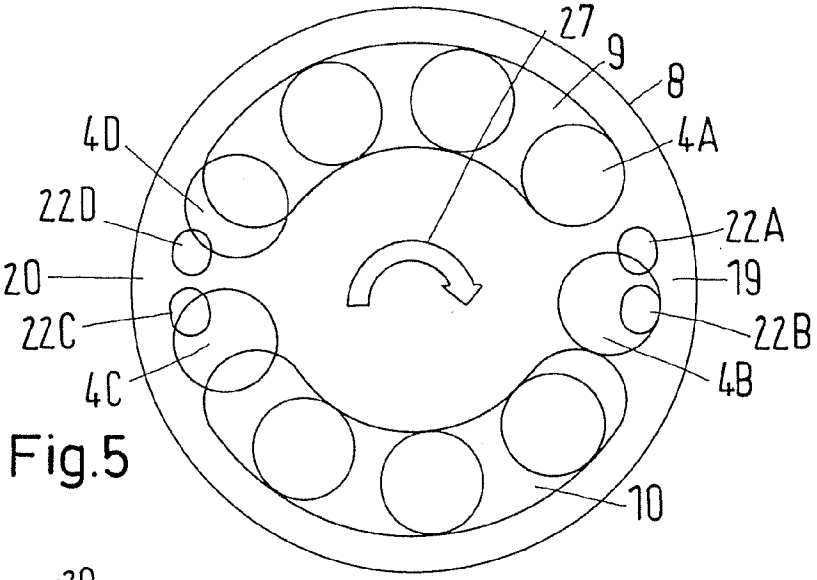
FIG. 5 is a schematic representation of the pressure shoe and front openings of the cylinders.
Figure 6:
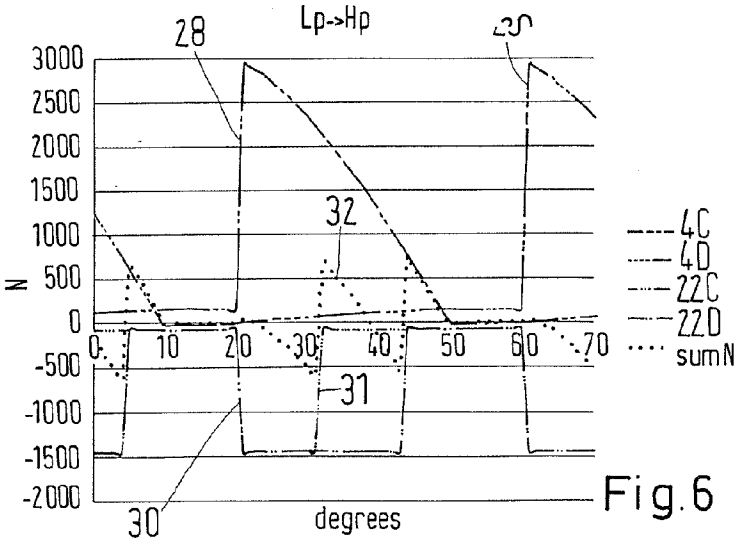
FIG. 6 is a diagram for an explanation of the transition between low pressure and high pressure.

The operation of the pressure cylinders 21 and the pressure pistons 22 are illustrated in connection with FIGS. 5 to 7. The same elements as in FIGS. 1 to 4 are designated with the same numerals.

The drum 2 comprises nine working cylinders. However, any other number of working cylinders can be used, both odd and even. For the purpose of explanation four working cylinders are referred to with reference numerals 4A, 4B, 4C, 4D. The working cylinders 4A, 4B are in a transition from high pressure to low pressure. The working cylinders 4C, 4D are in a transition between low pressure and high pressure.

Furthermore, the pressure pistons are referred to with numerals 22A, 22B, 22C and 22D, the pressure pistons 22A, 22B are located in the closed area 19 between the high pressure opening 9 and the pressure pistons 22C, 22D are located in the closed area 20 between the low pressure opening 10 and the high pressure opening 9.

Since the drum 2 comprises nine working cylinders 4, the centers of the working cylinders 4 have a distance in circumferential direction of 40°. In FIGS. 6 and 7 the degrees are on the horizontal axis whereas the forces are on the vertical axis. The drum 2 rotates in direction of an arrow 27. A graph 28 shows the forces generated by the pressure in the working cylinder 4C. A graph 29 shows the forces generated by a pressure in the working cylinder 4D.

At the same time the forces generated by the pressure in working cylinder 4C raises to a maximum, the counter force is generated by the pressure piston 22B, this counter force being illustrated by a graph 30.

The forces generated by the pressure working cylinder 4C decrease. When it has reached approximately half of its initial value, the pressure piston 22C is no longer loaded with the pressure in the working cylinder 4C as can be seen in graph 31. Graph 32 shows the sum of all forces. It can be seen, that the resulting force oscillates around the zero axis. This oscillation has a higher frequency than the oscillation of the forces generated by the pressures in the working cylinders 4C, 4D as shown by graphs 28, 29. However, the amplitudes are much smaller. This minimizes noises because the driving torque for the drum 2 can be kept more equal. Furthermore, wear is reduced.

Figure 7:
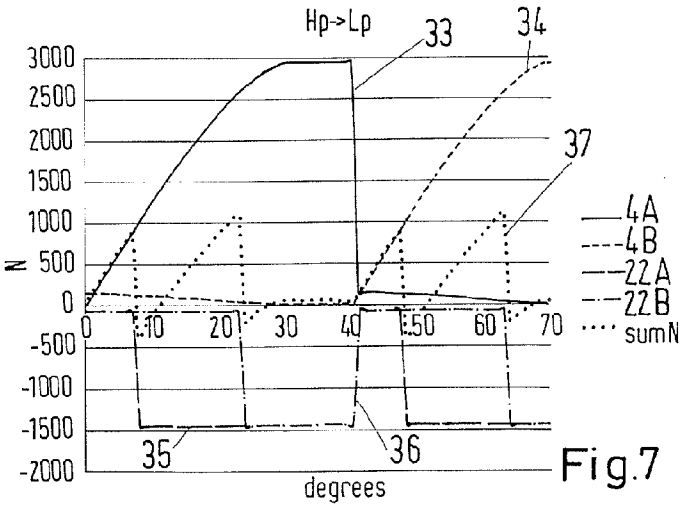
FIG. 7 is a corresponding diagram for the explanation of a transition from high pressure to low pressure.

A similar behavior is shown for the transition between high pressure and low pressure and shown in FIG. 7.

In FIG. 7 a graph 33 shows the forces generated by the pressure in working cylinder 4A and a graph 34 shows the forces generated by the pressure in the working cylinder 4B. A graph 35 shows the forces generated by the pressure piston 22A and a graph 36 shows the forces generated by the pressure piston 22B. A graph 37 shows the resulting forces on the pressure shoe 8. As explained in connection with FIG. 6, the resulting force oscillates around the zero axis with a higher frequency and a smaller maximum amplitude.

While the present invention has been illustrated and described with respect to a particular embodiment thereof, it should be appreciated by those of ordinary skill in the art that various modifications to this invention may be made without departing from the spirit and scope of the present.

What is claimed is:

1. A hydraulic pressure exchanger comprising a drum rotatable about an axis, a front plate arrangement having a front plate and a pressure shoe, said drum comprising a plurality of working cylinders, each working cylinder having a front opening, during rotation of said drum, each front opening sliding over said pressure shoe along a path, said pressure shoe having at least two kidney-shaped openings, said kidney-shaped openings being arranged in said path, wherein said pressure shoe is arranged between said drum and said front plate and comprises at least one pressure cylinder arranged between two neighboring kidney-shaped openings, a piston being arranged in at least one pressure cylinder, said piston resting against said front plate, said at least one pressure cylinder being connected with a supply opening in a side of the pressure shoe opposite said front plate, said supply opening at least partly overlapping said path.

2. The hydraulic pressure exchanger according to claim 1, wherein at least two pressure cylinders are arranged between two neighboring kidney-shaped openings, one behind the other in a direction of movement of said working cylinders.

3. The hydraulic pressure exchanger according to claim 1, wherein said supply opening is arranged eccentrically relative to a center of said at least one pressure cylinder.

4. The hydraulic pressure exchanger according to claim 1, wherein the center of said at least one pressure cylinder is arranged closer to the axis than said supply opening.

5. The hydraulic pressure exchanger according to claim 1, wherein said at least one pressure cylinder overlaps at least partially said path.

6. The hydraulic pressure exchanger according to claim 1, wherein the pressure shoe comprises a first port and at least one pressing cylinder, said at least one pressing cylinder opening to said front plate, a pressing piston being arranged in said at least one pressing cylinder, said at least one pressing cylinder being in fluid contact with said first port.

7. The hydraulic pressure exchanger according to claim 1, wherein at least two pressing cylinders are arranged in said pressure shoe.

8. The hydraulic pressure exchanger according to claim 7, wherein said pressing cylinders have the same cross section area.

9. The hydraulic pressure exchanger according to claim 6, wherein said pressure shoe comprises the first port and a second port on a side facing said first front plate, said first and second ports having a minimum distance along a straight line, said at least one pressing cylinder being offset to said straight line by a predetermined displacement.

10. The hydraulic pressure exchanger according to claim 9, wherein said at least one pressing cylinder is arranged between said first and second ports.

11. The hydraulic pressure exchanger according to claim 2, wherein said pressure cylinder overlap at least partially said path.

12. The hydraulic pressure exchanger according to claim 3, wherein said at least one pressure cylinder overlaps at least partially said path.

13. The hydraulic pressure exchanger according to claim 4, wherein said at least one pressure cylinder overlaps at least partially said path.

14. The hydraulic pressure exchanger according to claim 2, wherein the pressure shoe comprises a first port and at least one pressing cylinder, said at least one pressing cylinder opening to said front plate, a pressing piston being arranged in said at least one pressing cylinder, said at least one pressing cylinder being in fluid contact with said first port.

15. The hydraulic pressure exchanger according to claim 3, wherein the pressure shoe comprises a first port and at least one pressing cylinder, said at least one pressing cylinder opening to said front plate, a pressing piston being arranged in said at least one pressing cylinder, said at least one pressing cylinder being in fluid contact with said first port.

16. The hydraulic pressure exchanger according to claim 4, wherein the pressure shoe comprises a first port and at least one pressing cylinder, said at least one pressing cylinder opening to said front plate, a pressing piston being arranged in said at least one pressing cylinder, said at least one pressing cylinder being in fluid contact with said first port.

17. The hydraulic pressure exchanger according to claim 5, wherein the pressure shoe comprises a first port and at least one pressing cylinder, said at least one pressing cylinder opening to said front plate, a pressing piston being arranged in said at least one pressing cylinder, said at least one pressing cylinder being in fluid contact with said first port.

18. The hydraulic pressure exchanger according to claim 2, wherein at least two pressing cylinders are arranged in said pressure shoe.

19. The hydraulic pressure exchanger according to claim 3, wherein at least two pressing cylinders are arranged in said pressure shoe.

20. The hydraulic pressure exchanger according to claim 4, wherein at least two pressing cylinders are arranged in said pressure shoe.

* * * * *